US006935047B2

(12) United States Patent
Chan

(10) Patent No.: US 6,935,047 B2
(45) Date of Patent: Aug. 30, 2005

(54) HAIR STYLING ATTACHMENT

(76) Inventor: Wing Kin Chan, Block A-C, 4/F., Wing Hin Factory Building, 31-33 Ng Fong Street, San Po Kong, Kowloon (HK)

( * ) Notice: Subject to any disclaimer, the term of this patent is extended or adjusted under 35 U.S.C. 154(b) by 0 days.

(21) Appl. No.: 10/767,332

(22) Filed: Jan. 30, 2004

(65) Prior Publication Data

US 2004/0181962 A1 Sep. 23, 2004

(30) Foreign Application Priority Data

Jan. 30, 2003 (CN) ..... 03100772 A

(51) Int. Cl.[7] ..... A45D 25/00
(52) U.S. Cl. ..... 34/97
(58) Field of Search ..... 34/96, 97, 98, 34/99, 100; 132/211, 232; 219/225; 392/384, 385

(56) References Cited

U.S. PATENT DOCUMENTS 4,139,014 A * 2/1979 Rowland ..... 132/118
4,409,998 A * 10/1983 Bauer ..... 132/227
5,553,632 A * 9/1996 Burkhardt ..... 132/271
5,626,156 A * 5/1997 Vicory, Sr. ..... 132/229
5,660,191 A 8/1997 Bontoux et al.

FOREIGN PATENT DOCUMENTS

FR 2 785 159 A1 5/2000
WO WO 03/030675 A 4/2003

* cited by examiner

*Primary Examiner*—Stephen Gravini
(74) *Attorney, Agent, or Firm*—Burns, Doane, Swecker & Mathis, L.L.P.

(57) ABSTRACT

A hair styling attachment including a main housing and at least a pair of hair treating members, the hair treating member includes at least a thermally conductive hair treating surface, the pair of hair treating members being adjacently disposed with the corresponding hair treating surfaces on the pair of adjacent hair treating members generally in compressive contact, the corresponding hair treating surfaces on the pair of adjacent hair treating members being relatively displaceable to form a gap for receiving the hair to be treated, the main housing includes an air inlet and the hair treating surface being communicable with the air inlet.

8 Claims, 3 Drawing Sheets

SECTION A–A

SECTION B–B

SECTION C–C

SECTION D–D

SECTION A–A

SECTION C–C

SECTION D–D

HAIR STYLING ATTACHMENT

FIELD OF THE INVENTION

This invention relates to hair styling attachments, devices and apparatus and, more particularly, to hair styling attachments, devices and apparatus which operate with a hot or warm air source in the hair styling, setting or treating process. More specifically, although of course not solely limited thereto, this invention relates to attachments, devices and apparatus for hair straightening.

BACKGROUND OF THE INVENTION

Hair style setting attachments, devices and apparatus (collectively "hair formers") are widely used to effect designed or desirable hair styling for personal grooming or other requirements such as theatrical needs. In general, hair formers with the particular hair forming members can form specific designs of hair styling. For example, hair rollers or curlers are used to produce a curly effect on hair and hair straighteners are used to straighten hair which is otherwise curly.

Typically, to straighten hair a hair-dresser holds a comb or brush by one hand, engages the portion of hair to be straightened, imparting straightening tension to that portion of the hair by pulling towards the free end of the hair and then blow hot or warm hair onto that portion of the hair to impart more permanent hair styling setting to that portion of the hair. This requires the service of a hair-dresser and may not be comfortable to the customer because different customers may have different susceptibility to the straightening tension and different levels of straightening tension may be required to treat hair of different qualities.

Furthermore the traditional way of hair straightening requires two separate styling parts, namely, the comb or brush and the hair dryer or hot air blower. Since both hands are required, this may be inconvenient. Hence, it will be highly desirable if there can be provided an improved hair styling attachment, device or apparatus which alleviates the shortcomings associated with the above-mentioned conventional hair styling means and methods. More specifically, it is highly desirable to provide hair styling attachment, device or apparatus with integral means to simultaneously apply heat and tension to the hair for hair straightening.

OBJECT OF THE INVENTION

Accordingly, it is an object of the present invention to provide a hair styling attachment, device or apparatus which alleviates shortcomings associated with conventional means, methods and apparatus for hair styling, especially hair straightening. More specifically, it is an object of the present invention to provide a hair styling attachment, device or apparatus with integral means to simultaneously impart heat and tension to the hair or hair straightening. At a minimum, it is an object of this invention to provide the public with a useful choice of a hair styling attachment, device or apparatus.

SUMMARY OF THE INVENTION

According to the present invention, there is provided a hair styling attachment including a main housing and at least a pair of hair treating members, said hair treating member includes at least a thermally conductive hair treating surface, said pair of hair treating members being adjacently disposed with the corresponding hair treating surfaces on said pair of adjacent hair treating members generally in compressive contact, said corresponding hair treating surfaces on said pair of adjacent hair treating members being relatively displaceable to form a gap for receiving the hair to be treated, said main housing includes an air inlet and said hair treating surface being communicable with said air inlet.

According to another aspect of the present invention, a hair styling apparatus including a hair styling attachment of claim 5 and a hot air blower.

Preferably, said adjacent hair treating surfaces on said pair of adjacent hair treating members being resiliently displaceable to form said hair engaging gap.

Preferably, said hair treating members includes a first end and a second end, the first end being a free end and the second end being mounted on said main housing, the first end of at least one of said hair treating member of said pair of hair treating members being resiliently deflectable and/or displaceable with respect to said main housing.

Preferably, said hair treating member includes a generally cylindrical main body with a first cylindrical axis, said hair treating member includes at least a cylindrical roller with its cylindrical axis substantially parallel to and off-set from said first cylindrical axis so that at least part of the cylindrical surface of said cylindrical roller is exposed from said cylindrical surface of said cylindrical main body and forming said cylindrical body and from said hair treating surface.

Preferably, said main housing includes an upstream end and a downstream end, said hair treating members include a first and a second end, said first end being a free end and protrudes beyond said downstream end.

Preferably, said first end of said hair treating member being deflectable and/or displaceable relative to said main housing and said corresponding hair treating surfaces being generally convexly disposed with respect to each other.

Preferably, said hair treating member resembles a finger with a generally cylindrical body.

Preferably, said hair treating member includes a generally elongated and thermally insulated main body mounted with a metallic surface to form said hair treating surface.

Preferably, said metallic surface being generally curved with the same curvature extending along an axis of curvature, said axis of curvature being generally parallel to the longitudinal axis of said insulated main body.

Preferably, said attachment includes a plurality of hair treating members, wherein a first and a second hair treating surfaces are formed on some of said plurality of hair treating members, said hair treating surfaces on the same hair treating member being generally diametrically disposed on said cylindrical body.

Preferably, air entering said upstream end of said main housing can exit through the gap formed between adjacent hair treating members.

Preferably, said main housing includes an attachment means for coupling said device to a hot air blower.

Preferably, said attachment includes a plurality of hair treating members, wherein said plurality of hair treating members are linearly disposed.

Preferably, bristles generally parallel to the longitudinal axis said hair treating members are disposed on said main housing.

Preferably, the second ends of an adjacent pair of hair treating members co-operatively forms an hair engaging aperture, said hair engaging aperture being convergent towards said upstream end of said main housing.

Preferably, said styling device being detachable from said hot air blower.

BRIEF DESCRIPTION OF THE DRAWINGS

A preferred embodiment of the present invention will be explained in further detail below by way of examples and with reference to the accompanying drawings, in which.

DETAILED DESCRIPTION OF THE PREFERRED EMBODIMENTS

Figure 1:
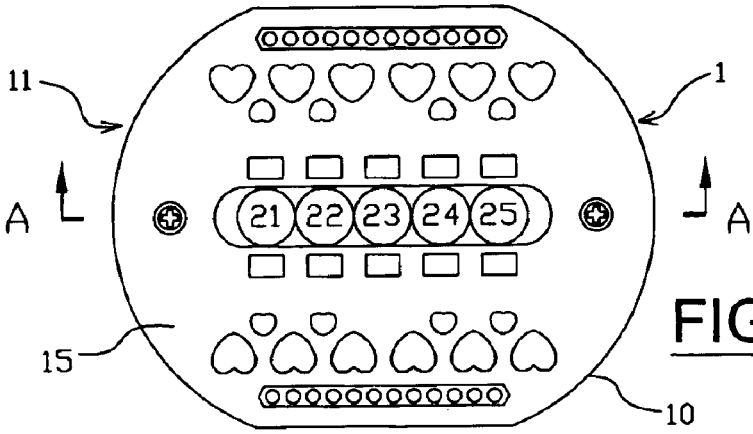
FIG. 1 is a top plan view of a preferred embodiment of a hair caring attachment of the present invention.
Figure 2:
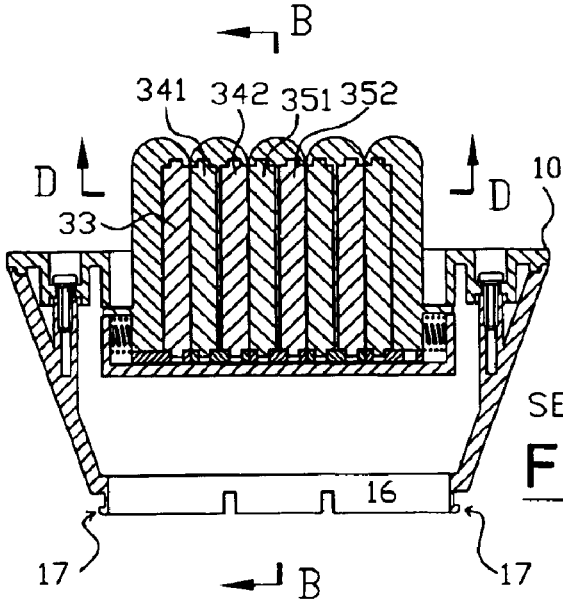
FIG. 2 is a cross-sectional view along the section line A—A of the attachment of FIG. 1.
Figure 3:
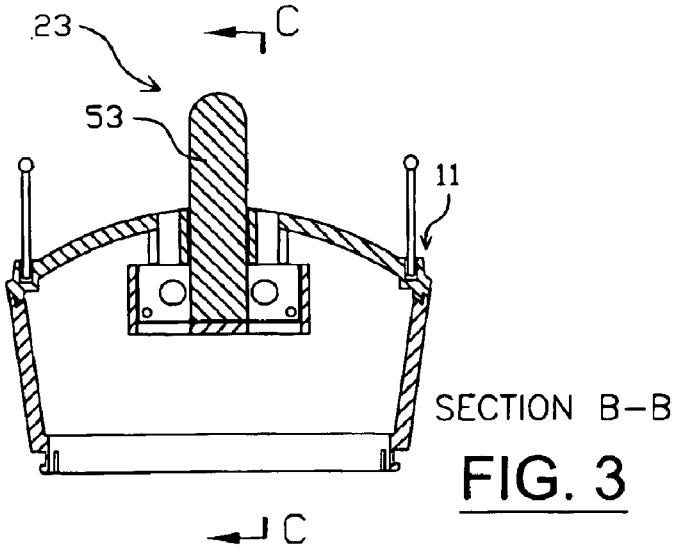
FIG. 3 is a cross-sectional view along the section line B—B of the attachment of FIG. 1.

Referring to the Figures, the hair styling device which is a hair styling attachment 1 for the present example includes a main housing 10 and a plurality of hair treating members 21–25. The main housing 10 includes a generally frusto-conical body with an upstream end 12, a downstream end 13 and a circumferential wall 14 interconnecting the upstream end and the downstream end. The downstream end of the main body 10 includes a top member 15 on which a sub-assembly including the plurality of the hair treating members 21–25 and a mounting base 26 is attached. The upstream end 16 of the main housing includes an air-inlet aperture and coupling means for attaching to a hot air blower such as a hair dryer. The coupling means includes a collar member 16 which extends generally along the axial direction of the frusto-conical main body and is provided with a circumferential flange 17 for, for example, latching engagement with the nozzle of the hot air blower.

The hair treating member 21–25 includes an elongated main body with a generally circular or rounded cross-section and a thermally conductive hair treating surface. The elongated main bodies of the plurality of the hair treating members are generally aligned with their longitudinal axes generally parallel and the corresponding hair treating surfaces in contiguous compressive contact.

In the present example, each of the main bodies of the hair treating members are generally cylindrical with a dome-shaped top or first end with the second end mounted on the base 26 of the main housing. The main bodies are preferably made of a thermally insulated material so as to avoid injuring the scalp of a user, although, of course, a thermally conductive main body can also be used. The dome-shaped first ends of the adjacent pairs of hair treating members co-operate to form a plurality of hair engaging apertures so that the hair treating members are adapted to more conveniently approach and engage the hair to be straightened. At least a roller is mounted with its longitudinal axis off-set from the cylindrical axis of the main body 51–55 of the hair treating member so that part of the curved surface is protruded from the cylindrical surface of the main body 51–55 of the hair treating members exposed to form the hair treating surface. While the rollers have a generally cylindrical body in this example, it will be noted that roller body of other geometry with a longitudinal extending curved surface can be used. For those hair treating members not disposed at the extreme ends i.e., hair treating members 22–24, a pair of rollers are mounted on each of the main bodies 52–54. These rollers are mounted off-set from the cylindrical axis of the main body and are disposed so that the curved cylindrical surfaces of the corresponding cylindrical rollers are slightly pressing against each other under spring bias.

Figure 4:
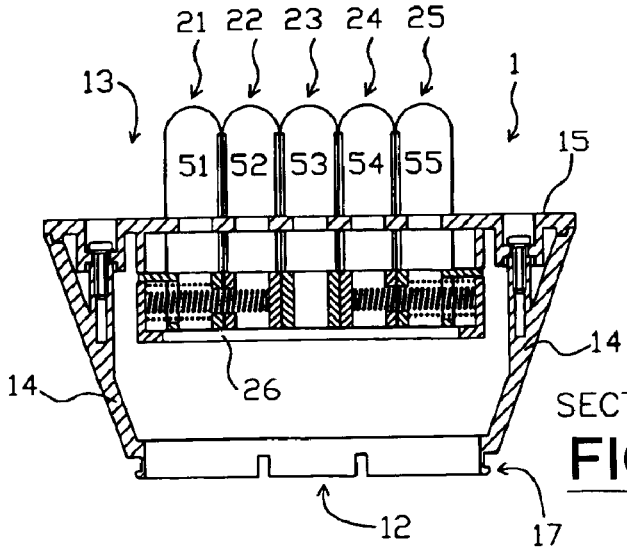
FIG. 4 is a cross-sectional view along the section line C—C of the attachment of FIG. 1.
Figure 5:
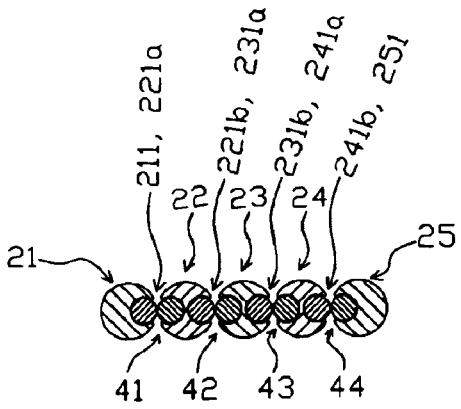
FIG. 5 is a cross-sectional view along the section line D—D of the attachment of FIG. 1.
Figure 5A:
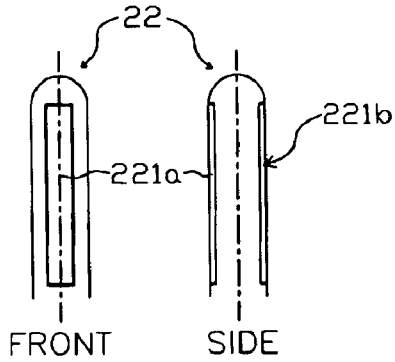
FIG. 5A shows the front and side views of an exemplary hair treating member.
Figure 6:
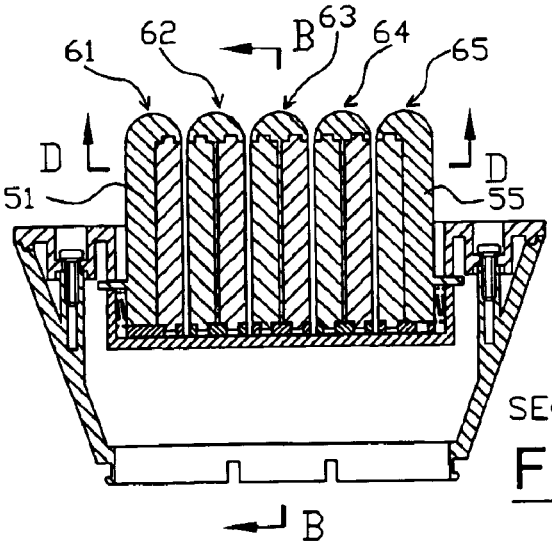
FIG. 6 shows the same cross-sectional view as FIG. 2 but with the hair treating members displaced relative to each other.
Figure 7:
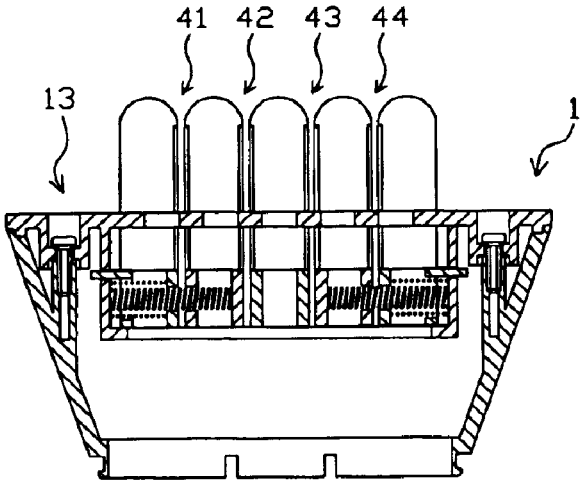
FIG. 7 is a sectional view along the line C—C corresponding to FIG. 6.
Figure 8:
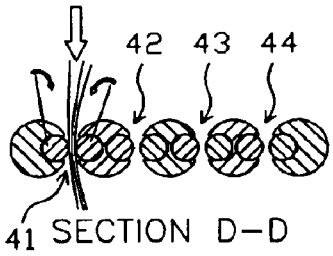
FIG. 8 illustrates engagement of hair by a pair of adjacent hair treating members.
Figure 9:
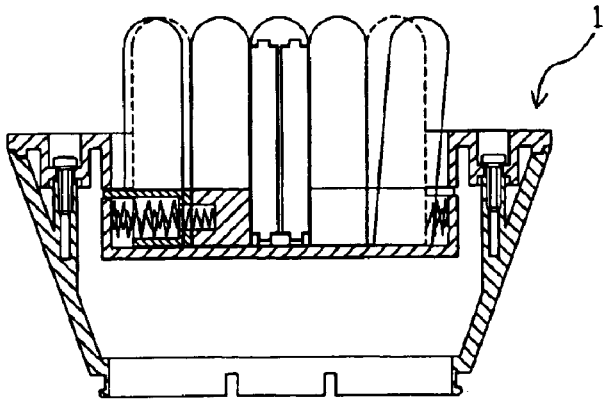
FIG. 9 illustrates the displacement of one of the hair treating member the hair is engaged between the left-most pair of the hair treating members.

Referring to FIGS. 4 and 7–9, the hair treating members 21–25 are mounted on a base housing 26 and are disposed so that the longitudinal axes of the hair treating members are generally parallel to each other with the partially cylindrical hair treating surfaces facing each other and in generally compressive contact. The hair treating members are generally linearly disposed and mounted on a channel formed on the base housing 26. Some of the hair treating members, for example, 21, 22, 24 and 25 are mounted with spring biasing so that they are urged by a lateral urging force along the transversal direction, i.e. the direction which is generally transversal to the axial or longitudinal axis of the cylindrical body, towards their neutral positions.

The hair treating members are disposed so that they can be slightly displaced or deflected by acting against the spring urging force to form a plurality of hair treating gaps 41–44. The channel provides a guide to the deflection or displacement of the movable hair treating members. It will be observed that the hair treating fingers 21–25 generally resemble a collection of parallelly disposed fingers each with a top free end protruding beyond the top member 15 of the main housing 10. The hair treating members 21–25 include a rounded or dome-shaped head 61–65 and the adjacent heads co-operate to form a hair engaging aperture which is convergent towards the downstream end of the main body so that they can gradually approach the hair and easily engage a small bundle of hair between the gaps formed by the adjacent hair treating members. It will be appreciated that the convergent apertures formed between adjacent rounded or dome-shaped heads assist convenient engagement of the desirable portion of hair.

Turning now to the operation of this preferred embodiment, the hair styling attachment 1 is coupled onto the outlet nozzle of a hot hair blower so that hot air is delivered towards the plurality of hair treating members via the upstream end air inlet 12. The circumferential wall 14 of the main body defines an air enclosure so that the air entering the upstream end 12 will travel towards the downstream end 13. When hair treating gaps are formed upon engagement of the hair between the gaps, a portion of the hot air will exit through the base aperture between the adjacent displaced hair treating members and generally travel along the partially cylindrical hair treating surface. This will cause the hair treating surfaces to be heated up and, since the hair is caught under tension, movement of the hair treating members towards the end of the hair by, for example, moving the hair styling device will straighten the hair in a manner similar to ironing the hair by the hair treating surfaces.

It will be appreciated that the present attachment or features of this attachment can be incorporated with a hot air blowing device to form a standalone unit or apparatus for the same hair styling purposes.

While the present invention has been explained by reference to the preferred embodiments described above, it will be appreciated that the embodiments are only illustrated as examples to assist understanding of the present invention and are not meant to be restrictive on its scope. In particular, the scope, ambit and spirit of this invention are meant to include the general principles of this invention as inferred or exemplified by the embodiments described above. More particularly, variations or modifications which are obvious or trivial to persons skilled in the art, as well as improvements made on the basis of the present invention, should be considered as falling within the scope and boundary of the present invention.

Furthermore, while the present invention has been explained by reference to an hair styling attachment, it should be appreciated that the invention can apply, whether with or without modifications, to other hair styling devices or apparatus incorporating features of the present invention without loss of generality.

What is claimed is:

1. A hair styling attachment comprising a main housing and a plurality of elongated hair styling members, said main housing comprising a hollow compartment with an upstream end, a downstream end and an attachment means at said upstream end for coupling said device to an outlet nozzle of a hot air blowing device, said plurality of elongated hair styling members protruding from said downstream end of said main housing and extending along a longitudinal direction, each said elongated hair styling member comprising a thermally conductive hair styling surface, said plurality of hair styling members being disposed so that corresponding hair styling surfaces on an adjacent pair of styling members are oppositely aligned for compressively engaging tresses of hair between said pair of styling surfaces during normal use, wherein each said hair styling surface is freely rotatable about an axis which is substantially parallel to said longitudinal axis of said elongated hair styling member.

2. A hair styling attachment according to claim 1, wherein said plurality of hair styling members are disposed on a row and are movable against spring bias relative to each other and relative to said main housing along a transversal direction.

3. A hair styling attachment according to claim 2, wherein the separation between an adjacent pair of hair styling members can be enlarged by overcoming spring bias which acts on said styling members and along said transversal direction.

4. A hair styling attachment according to claim 1, wherein said plurality of hair styling members comprises a first hair styling member, a last hair styling member and a plurality of immediate hair styling members which are disposed intermediate said first and last hair styling members, each said intermediate hair styling member comprising a pair of cylindrical rollers of a thermally conductive material, each said cylindrical roller being freely rotatable about an axis which is substantially parallel to the longitudinal axis of said hair styling member, with the cylindrical surface of said thermally conductive roller forming said hair styling surface.

5. A hair styling attachment according to claim 4, wherein said plurality of hair styling members are relatively movable with respect to each other and with respect to said main housing and along a predefined track.

6. A hair styling attachment according to claim 5, wherein said styling members are also deflectable about said longitudinal direction.

7. A hair styling attachment according to claim 5, wherein a pair of adjacent hair styling members are disposed so that corresponding hair styling surfaces are oppositely aligned with their convex surfaces adjacently disposed and facing each other.

8. A hair styling attachment according to claim 1, wherein each said hair styling member resembles a finger with a generally rounded head at its longitudinal end, and the space between an adjacent pair of said rounded heads forms a hair engaging aperture whereby hair can be guided into the space between an adjacent pair of hair styling surfaces via said hair engaging aperture.

* * * * *